US007684979B2

(12) United States Patent
Ozawa

(10) Patent No.: US 7,684,979 B2
(45) **Date of Patent: *Mar. 23, 2010**

(54) BAND EXTENDING APPARATUS AND METHOD

(75) Inventor: Kazunori Ozawa, Tokyo (JP)

(73) Assignee: NEC Corporation, Tokyo (JP)

( * ) Notice: Subject to any disclaimer, the term of this patent is extended or adjusted under 35 U.S.C. 154(b) by 1351 days.

This patent is subject to a terminal disclaimer.

(21) Appl. No.: 11/118,337

(22) Filed: May 2, 2005

(65) Prior Publication Data

US 2005/0256709 A1 Nov. 17, 2005

Related U.S. Application Data

(63) Continuation of application No. PCT/JP03/13231, filed on Oct. 16, 2003.

(30) Foreign Application Priority Data

Oct. 31, 2002 (JP) ..... 2002-317203

(51) Int. Cl.
*G10L 21/02* (2006.01)

(52) U.S. Cl. ..... 704/226; 704/206; 704/220

(58) Field of Classification Search ..... 704/226, 704/205, 220

See application file for complete search history.

(56) References Cited

U.S. PATENT DOCUMENTS 5,455,888 A * 10/1995 Iyengar et al. ..... 704/203
5,596,676 A * 1/1997 Swaminathan et al. ..... 704/208
5,752,223 A 5/1998 Aoyagi et al.
5,819,213 A 10/1998 Oshikiri et al.
5,978,759 A 11/1999 Tsushima et al.

(Continued)

FOREIGN PATENT DOCUMENTS

CN 1273663 11/2000

(Continued)

OTHER PUBLICATIONS

P. Jax et al., "Wiseband extensionof Telephone Speech Using Hidden Markov Model", Poc. IEEE Speech Coding Workship, pp. 133-135, 2000.

(Continued)

*Primary Examiner*—Qi Han
(74) *Attorney, Agent, or Firm*—Young & Thompson

(57) ABSTRACT

A band extending apparatus includes a spectral parameter calculating circuit for calculating spectral parameters of a narrow-band input signal, a coefficient calculating circuit supplied with the spectral parameters to convert the spectral parameters into coefficients of a band extended signal, and a gain circuit supplied with a gain from a gain adjustment circuit and multiplying an output signal of a noise generating circuit with the gain to output the resulting signal to a synthesis filter circuit. The synthesis filter circuit forms a filter by receiving coefficients from the coefficient calculating circuit. The signal from the gain circuit is passed through the filter. The synthesis filter circuit outputs a high band signal for band extension. The band extending apparatus also includes a sampling frequency converting circuit, supplied with the narrow-band input signal to output a signal up-sampled to a preset sampling frequency, and an adder for summing the high band signal to the up sampled signal to output a band extended signal.

22 Claims, 6 Drawing Sheets

U.S. PATENT DOCUMENTS

| | | | | |
|---|---|---|---|---|
| 6,363,340 | B1 | 3/2002 | Sluijter et al. | |
| 6,377,915 | B1 | 4/2002 | Sasaki | |
| 7,151,802 | B1 | 12/2006 | Bessette et al. | |
| 2002/0038210 | A1 | 3/2002 | Yajima | |
| 2002/0052745 | A1 | 5/2002 | Miseki | |
| 2002/0123885 | A1* | 9/2002 | Sluijter et al. | 704/201 |
| 2002/0138268 | A1* | 9/2002 | Gustafsson | 704/258 |
| 2003/0050786 | A1* | 3/2003 | Jax et al. | 704/500 |
| 2005/0004803 | A1* | 1/2005 | Smeets et al. | 704/500 |
| 2005/0187759 | A1* | 8/2005 | Malah et al. | 704/200 |
| 2006/0277036 | A1* | 12/2006 | Bessette et al. | 704/207 |

FOREIGN PATENT DOCUMENTS

| | | |
|---|---|---|
| CN | 1328681 | 12/2001 |
| EP | 0 945 852 | 9/1999 |
| EP | 1 207 519 | 5/2002 |
| EP | 1 420 389 | 5/2004 |
| JP | 61-107400 | 5/1986 |
| JP | 63-217732 | 9/1988 |
| JP | 5-134699 | 5/1993 |
| JP | 7-56598 | 3/1995 |
| JP | 8-123495 | 5/1996 |
| JP | 8-146998 | 6/1996 |
| JP | 8-248997 | 9/1996 |
| JP | 9-55778 | 2/1997 |
| JP | 09-127985 | 5/1997 |
| JP | 9-190197 | 7/1997 |
| JP | 9-269798 | 10/1997 |
| JP | 2000-003200 | 1/2000 |
| JP | 2000-10597 | 1/2000 |
| JP | 2000-267700 | 9/2000 |
| JP | 2000-298500 | 10/2000 |
| JP | 2001-13998 | 1/2001 |
| JP | 2002-132300 | 5/2002 |
| WO | 00/25305 | 5/2000 |
| WO | WO 01/35395 | 5/2001 |

OTHER PUBLICATIONS

Sugamura et al., "Speech InformationCompression by Voice Analysis Synthesis System", Extended Abstract Society of Electronic Communication, J64-A, pp. 599 r-606, 1981.

Epps, *Wideband Extension of Narrowband Speech for Enhancement and Coding*, Sep. 2000, pp. 1-65, School of Electrical Engineering and Telecommunications, The University of New South Wales, XP-002197876.

Epps et al., "Speed enhancement using STC-based bandwidth extension," Oct. 1998, pp. 711-714., XP-007000515.

Japanese Office Action 2002-317203.

Epps. J., "Wideband Extension of Narrowband Speech for Enhancement and Coding", Sep. 200, XP002197876.

Canadian Patent Office issued a Canadian Office Action dated May 26, 2009, Application No. 2,504,175.

Chinese Patent Office issued a Chinese Office Action dated Feb. 20, 2009, Application No. 200380102290.0.

Japanese Patent Office issued a Japanese Office Action dated Mar. 31, 2009, Application No. 2002-317203.

* cited by examiner

BAND EXTENDING APPARATUS AND METHOD

CROSS-REFERENCE TO RELATED APPLICATIONS

This application is a continuation of International Application No. PCT/JP2003/013231, filed on Oct. 16, 2003, and claims priority to Japanese Patent Application No. 2002-317203, filed on Oct. 31, 2002, both of which are incorporated herein by reference in their entireties.

TECHNICAL FIELD

This invention relates to a method and an apparatus for extending the band, according to which a narrow-band signal is entered as input signal and a band extended signal having enlarged frequency range of the input signal is output to improve the acoustic sound quality.

BACKGROUND ART

There has been known a system in which the frequency range of a speech signal, encoded at a low bit rate and reproduced, is extended on the receiving side without the transmitting side having to send the auxiliary information for band extension (for example, see Non-Patent Publication 1).

Non-Patent Publication 1:

P. Jax, P. Vary, "Wideband extension of telephone speech using hidden Markov model", Proc. IEEE Speech Coding Workshop, pp. 133-135, 2000.

With this state-of-the-art system, filter coefficients after band extension using HMM (Hidden Markov Model) are retrieved on the receiving side.

On the other hand, the processing for directly extending the band of the narrow-band input signal is unprecedented.

In the state-of-the-art method, shown in the Publication 1, in which modeling by HMM of filter coefficients or the broadband spectral envelope of speech is required, the following problem arises. That is, HMM model parameters need to be determined off-line at the outset from a voluminous speech database in a manner which entails prolonged computing time and increased cost. In addition, retrieval by an HMM model is needed for the receiving side to carry out band extension processing in real time, for which a large volume of calculations are required.

Accordingly, it is an object of the present invention to overcome the aforementioned problem and to provide a method and an apparatus for directly extending the frequency range of a narrow-band input signal. It is another object of the present invention to provide a method and an apparatus for extending the frequency range whereby the band-extended speech of optimum sound quality may be obtained with computational complexity less than that of the state-of-the-art system.

DISCLOSURE OF THE INVENTION

According to the present invention, when an input signal of a preset frequency range at least is entered and the frequency range of the input signal is extended, the spectral parameters of the input signal of the preset frequency range are calculated, the frequency of the spectral parameters is shifted, filter coefficients of the spectral parameters are then found and a band-extended signal is then generated, using the noise signal, generated by a noise generating unit, the filter coefficients and the input signal.

In one aspect, the present invention provides a band extending apparatus comprising: a spectral parameter calculating unit, supplied at least with an input signal of a preset frequency band to calculate spectral parameters representing spectral characteristics, a noise generating unit for generating a noise signal, a coefficient calculating unit for shifting the frequency of the spectral parameters to then find filter coefficients, a gain unit for supplying gain to an output of the noise generating unit, a synthesis filter unit for passing an output signal of the gain unit through a synthesis filter, formed using the filter coefficients, to reproduce a signal for band extension, and means for summing a signal converted from a sampling frequency of the input signal to an output signal of the synthesis filter unit to generate a band extended signal.

In another aspect, the present invention provides a band extending apparatus comprising: a spectral parameter calculating unit, supplied at least with an input signal of a preset frequency band to calculate spectral parameters representing spectral characteristics, an adaptive codebook unit, calculating a pitch period at least from the input signal to generate an adaptive codebook component based on the pitch period and a past sound source signal, a noise generating unit for generating a noise signal, a coefficient calculating unit for shifting the frequency of the spectral parameters to find filter coefficients, a gain unit for supplying a gain to at least one of an output signal of the noise generating unit and an output signal of the adaptive codebook unit, and for summing the resulting output signals to output a sound source signal, a synthesis filter unit for receiving the sound source signal from the gain unit to a synthesis filter formed using the filter coefficients to reproduce a signal for band extension, and means for summing a signal, corresponding to the input signal converted in a sampling frequency thereof to an output signal of the synthesis filter unit to produce a band extended signal.

In a further aspect, the present invention provides a band extending apparatus comprising: a spectral parameter calculating unit, supplied at least with an input signal of a preset frequency band to calculate spectral parameters representing spectral characteristics, an adaptive codebook unit for calculating a pitch period at least from the input signal to generate an adaptive codebook component based on the pitch period and past sound source signal, a noise generating unit for generating a noise signal, a coefficient calculating unit for shifting the frequency of the spectral parameters to then find filter coefficients, a gain unit for supplying gain to at least one of an output of the noise generating unit and an output signal of the adaptive codebook unit and for summing the resulting signal to output a sound source signal, and a synthesis filter unit in which the sound source signal is passed through a pitch pre-filter and at least an output signal of the pitch pre-filter is entered at least to a synthesis filter formed using the filter coefficient to reproduce the signal for band extension. After converting the sampling frequency of the replay signal, an output signal of the synthesis filter unit is summed and the resulting signal is output.

The band extending apparatus of the present invention may be provided with a low-pass filter supplied with an output of the adaptive codebook unit as an input.

The band extending apparatus of the present invention may also be provided with a post filter, employing weighting coefficients, corresponding to weighted version of the coefficients. An output signal of the synthesis filter unit may be passed through the post-filter to reproduce the signal for band extension.

In a further aspect, the present invention provides a band extending method comprising: the steps of (A01) being supplied with an input signal of a preset band at least to calculate spectral parameters representing spectral characteristics, (A02) shifting the frequency of the spectral parameters to then find filter coefficients, (A03) supplying the gain to a noise signal generated in the noise generating unit, (A04) passing a signal, added by the gain, through a synthesis filter, formed using the filter coefficients, to reproduce a signal for band extension, and (A05) summing a signal corresponding to the input signal converted in a sampling frequency thereof to an output signal of the synthesis filter unit to generate a band extended signal.

In a further aspect, the present invention provides a band extending method comprising: the steps of (A11) receiving the input signal of the preset frequency band at least to calculate spectral parameters representing spectral characteristics, (A12) calculating a pitch period at least from the input signal to generate an adaptive codebook component based on the pitch period and a past sound source signal, (A13) shifting the frequency of the spectral parameters to find filter coefficients, (A14) supplying a gain to at least one of a noise signal from a noise generating unit and to the adaptive codebook component and for summing the resulting output signals to output a sound source signal, (A15) receiving the sound source signal from the gain unit to a synthesis filter formed using the filter coefficients to reproduce a signal for band extension, and (A16) summing a signal, corresponding to the input signal converted in a sampling frequency thereof to an output signal of the synthesis filter unit to produce a band extended signal.

In a further aspect, the present invention provides a band extending method comprising: the steps of (A21) receiving at least an input signal of a preset frequency band to calculate spectral parameters representing spectral characteristics, (A22) calculating a pitch period at least from the input signal to generate an adaptive codebook component based on the pitch period and the past sound source signal, (A23) shifting the frequency of the spectral parameters to then find filter coefficients, (A24) supplying a gain to at least one of a noise signal from a noise generating unit and the adaptive codebook component and for summing the resulting signal to output a sound source signal, (A25) pre-filtering the sound source signal, using the pitch period, (A26) supplying the results of processing of the pitch pre-filter to a synthesis filter formed using the filter coefficients to generate a signal for band extension, and (A27) summing a signal corresponding to the input signal converted in a sampling frequency thereof to an output signal of the synthesis filter unit to generate a band extended signal.

In a further aspect, the present invention provides a band extending method comprising: the steps of (A31) receiving at least an input signal of a preset frequency band to calculate spectral parameters representing spectral characteristics, (A32) calculating a pitch period at least from the input signal to generate a period signal using the pitch period, (A33) shifting the frequency of the spectral parameters to find filter coefficients, (A34) supplying a proper gain to at least one of a noise signal of the noise generating unit and the period signal and for summing the resulting output signals to output a sound source signal, (A35) receiving the sound source signal to a synthesis filter formed using the filter coefficients to reproduce a signal for band extension, and (A36) summing a signal, corresponding to the input signal converted in a sampling frequency thereof to an output signal of the synthesis filter unit, to produce a band extended signal.

In a further aspect, the present invention provides a band extending method comprising: the steps of (A41) receiving at least an input signal of a preset frequency band and calculating spectral parameters representing spectral characteristics, (A42) calculating a pitch period at least from the input signal to generate a period signal using the pitch signal, (A43) shifting the frequency of the spectral parameters to then find filter coefficients, (A44) supplying a gain to at least one of an output signal of the noise generating unit and the pitch signal and for summing the resulting output signals to output a sound source signal, (A45) pre-filtering the sound source signal using the pitch period, (A46) inputting a signal representing the result of processing by the pitch pre-filter to a synthesis filter formed using the pitch period to reproduce a signal for band extension, and (A47) summing a signal, corresponding to the input signal converted in a sampling frequency thereof to an output signal of the synthesis filter unit to produce a band extended signal.

The method of the present invention may include the step of processing the adaptive codebook components by the low-pass filter to permit frequency components not higher than a predetermined cut-off frequency to pass therethrough.

The method of the present invention may include the step of passing an output signal of the synthesis filter through a post-filter, formed using weighting coefficients, obtained on weighting the filter coefficients, to regenerate a signal for band extension.

The present invention has such meritorious effect that a band extended signal (e.g. 7 kHz band signal) may be generated by generating a high frequency signal with processing for a narrow-band input signal (e.g. 4 kHz band signal) and by summing the resulting high frequency signal to a signal corresponding to the narrow-band input signal having its sampling frequency changed.

The present invention has such meritorious effect that a band extended signal with optimum sound quality may be generated in case periodicity is required for a high frequency part of the signal, such as a vowel, by generating an adaptive codebook signal, using a delay calculated from the narrow-band input signal, and by multiplying the so generated adaptive codebook signal with a gain and by summing the resulting signal to a noise signal.

The present invention also has such meritorious effect that a band extended signal for higher sound quality may be generated by employing a pitch pre-filter for a sound source signal, using the delay, or by weighting the coefficients from the coefficient calculating circuit for use for the post-filter.

PREFERRED EMBODIMENTS OF THE INVENTION

For more detailed explanation of the present invention, preferred embodiments of the present invention will be explained with reference to the drawings. It is presupposed in the following that a narrow-band input signal of a 4 kHz range is extended in band to a 5 kHz band or to a 7 kHz band.

Figure 1:
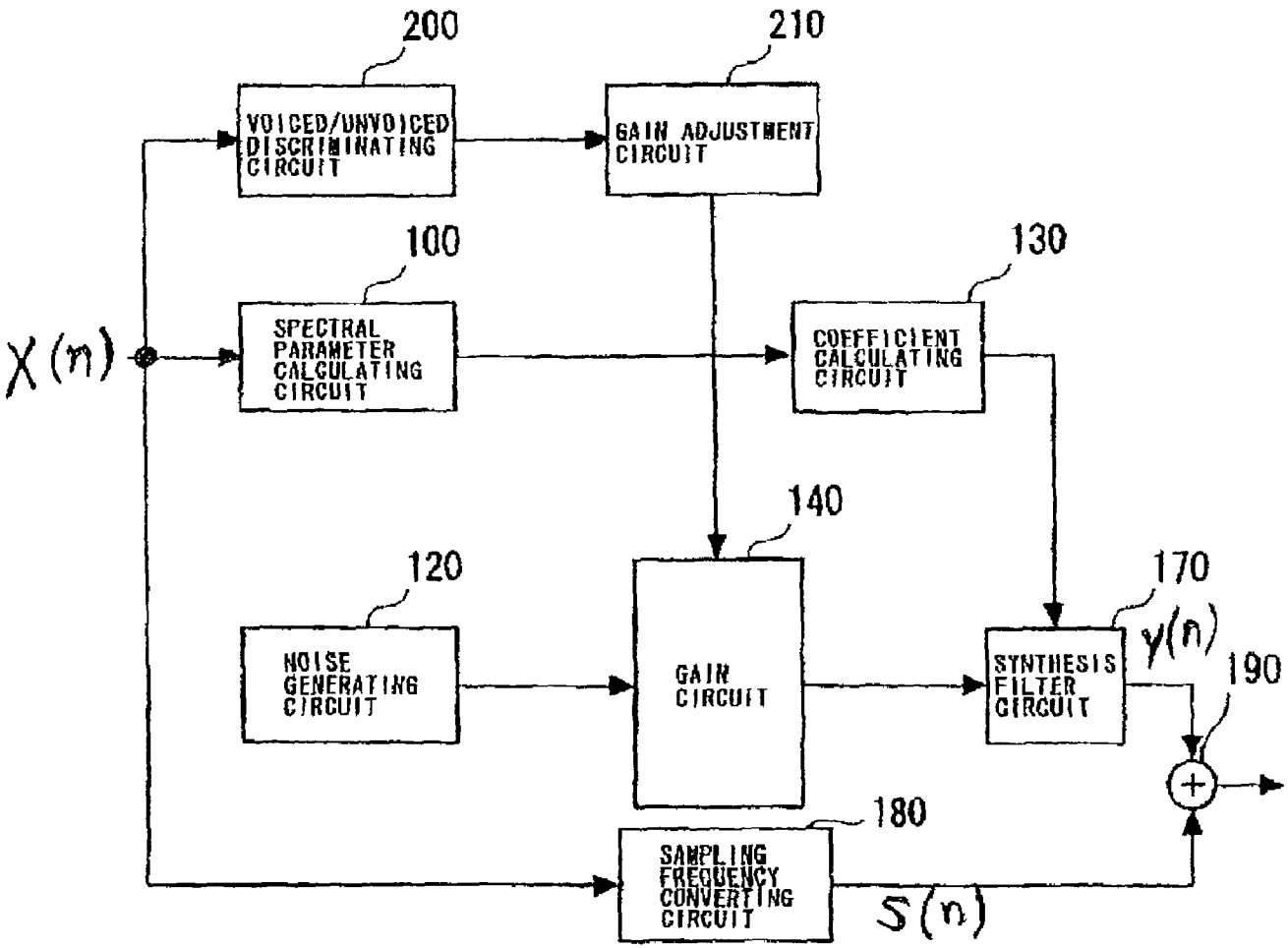
FIG. 1 is a diagram showing a configuration of a first embodiment of the present invention.

FIG. 1 shows the configuration of a first embodiment of the present invention. Referring to FIG. 1, a band extension apparatus of the first embodiment includes a spectral parameter calculating circuit 100, a noise generating circuit 120, a coefficient calculating circuit 130, a gain circuit 140, a synthesis filter circuit 170, a sampling frequency converting circuit 180, an adder 190, a voiced/unvoiced discriminating circuit 200 and a gain adjustment circuit 210.

In the band extending apparatus, supplied with a narrow-band input signal x(n), the spectral parameter calculating circuit 100 divides the input signal into plural frames, each being e.g. of 10 ms, and calculates spectral parameters of a predetermined number of orders P from frame to frame. It is noted that the spectral parameters represent parameters showing the outline shape of spectrum of a speech signal in terms of a frame as a unit. For the calculation, LPC analysis, as known per se, for example, is used. The spectral parameter calculating circuit 100 also converts the linear prediction coefficients $\alpha i$(i=1, . . . P), calculated by the LPC analysis, into LPC parameters suitable for quantization or interpolation, to output the so formed LPC parameters. For converting the linear prediction coefficients into LSP, reference is made e.g. to the following treatises (for example see Non-Patent Publication 2):

Non-Patent Publication 2:

Sugamura and Itakura: "Speech Information Compression by Voice Analysis Synthesis System", Extended Abstract to Society of Electronic Communication, J64-A, pp. 599 t-606, 1981

The coefficient calculating circuit 130 is supplied with the spectral parameters and converts the parameters into coefficients of the band extended signal. For this conversion, well-known techniques, such as a technique for simply shifting the LSP frequency to a higher frequency, a technique for non-linear conversion or a technique for linear conversion, may be used. Here, the frequency band in which the LSPs are present is shifted to a higher frequency range, using all or part of the LSP parameters, for conversion to order-P linear prediction coefficients, which order-P linear prediction coefficients are then output to the synthesis filter circuit 170.

The noise generating circuit 120 generates a band-limited noise signal, having an average amplitude value normalized to a predetermined level, for a time duration equal to the frame duration, and outputs the so generated noise signal to the gain circuit 140. As the noise signal, the white noise is here used. However, other noise signal may also be used.

The voiced/unvoiced discriminating circuit 200 is supplied with the narrow-band input signal x(n) to verify whether the frame-based signal is voiced or unvoiced. For verifying whether the frame-based signal is voiced or unvoiced, a normalized autocorrelation function D(T) up to a predetermined delay time m (m being an integer) is derived for the narrow-band input signal x(n) in accordance with the equation (1):

$$D(T) = \left[\sum_{n=0}^{N-1} x(n)x(n-T)\right] \Big/ \left[\sum_{n=0}^{N-1} x^2(n-T)\right] \tag{1}$$

and a maximum value of D(T) is found. If the maximum value of D(T) is larger than a predetermined threshold value, the input signal is determined to be voiced. If otherwise, the input signal is determined to be unvoiced.

The voiced/unvoiced discriminating circuit 200 outputs the voiced/unvoiced discrimination information to the gain adjustment circuit 210. In the above equation (1), N denotes the number of samples for calculating the normalized autocorrelation.

The gain adjustment circuit 210 is supplied with the voiced/unvoiced discrimination information from the voiced/unvoiced discriminating circuit 200 and adjusts the gain to be imparted to the noise signal depending on whether the input signal is voiced or unvoiced, to output the so adjusted gain to the gain circuit 140.

The gain circuit 140 is supplied with the gain from the voiced/unvoiced discriminating circuit 200 and multiplies the output signal of the noise generating circuit 120 with the gain to output the resulting signal to the synthesis filter circuit 170.

The synthesis filter circuit 170 is supplied with the output signal of the gain circuit 140 and with coefficients of a predetermined number of orders, from the coefficient calculating circuit 130, to form a filter, and outputs a high frequency range signal y(n) needed for band extension.

The sampling frequency converting circuit 180 up-samples the narrow-band input signal x(n) to a predetermined sampling frequency to output the resulting up-sampled signal.

The adder 190 sums an output signal y(n) of the synthesis filter circuit 170 and an output signal s(n) of the sampling frequency converting circuit 180 to each other to form and output an ultimately band extended signal.

The above completes the explanation of the first embodiment.

Figure 2:
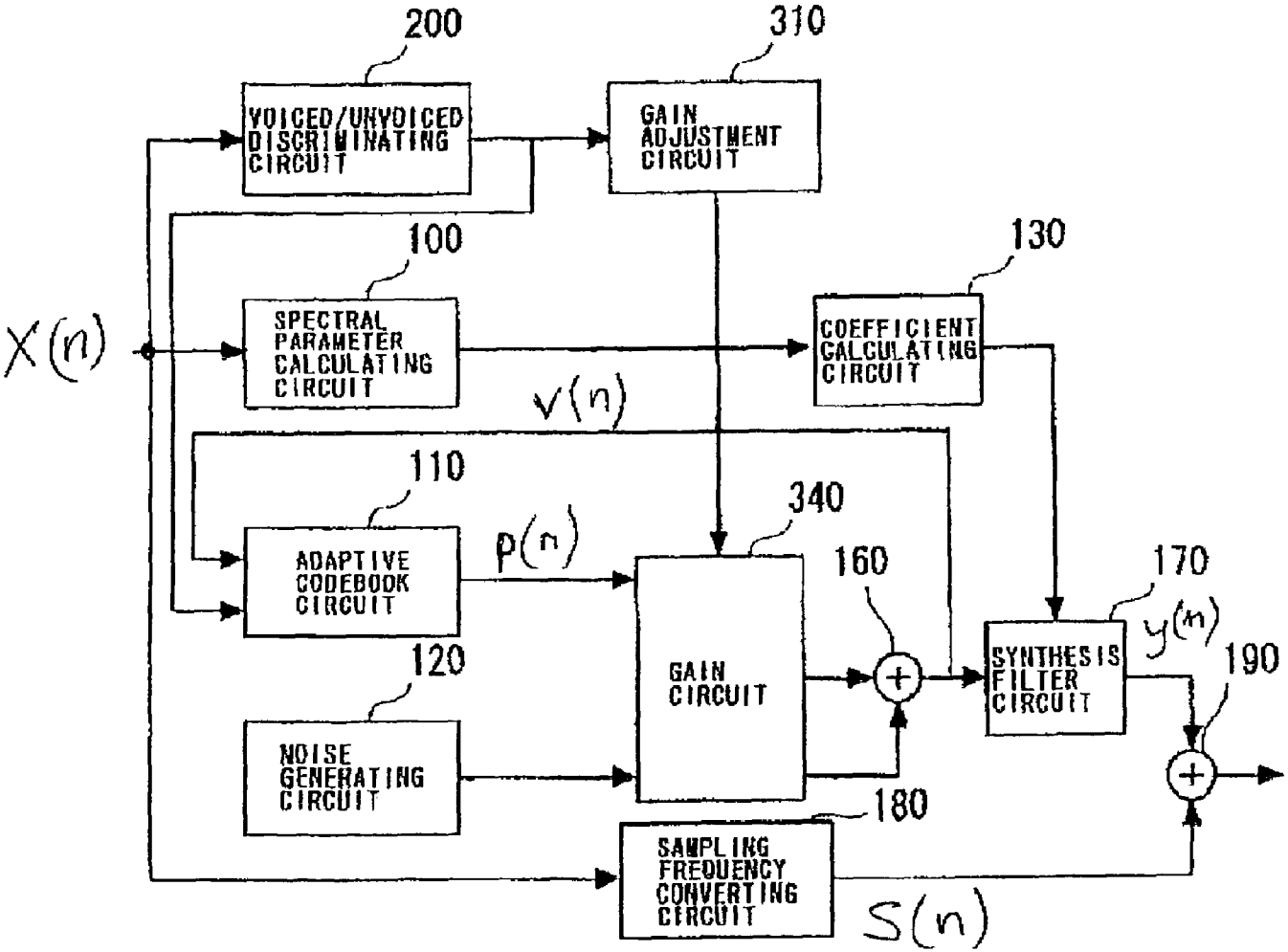
FIG. 2 is a diagram showing a configuration of a second embodiment of the present invention.

FIG. 2 shows the configuration of a second embodiment of the present invention. Referring to FIG. 2, the band extending apparatus of the second embodiment includes a spectral parameter calculating circuit 100, an adaptive codebook circuit 110, a noise generating circuit 120, a coefficient calculating circuit 130, a gain circuit 340, a synthesis filter circuit 170, a sampling frequency converting circuit 180, adders 160, 190, a voiced/unvoiced discriminating circuit 200, and a gain adjustment circuit 310. In FIG. 2, the same reference numerals are used to depict the same parts or components as those shown in FIG. 1. In the following, only the points of difference from FIG. 1 are explained, whilst the same parts or components as those of FIG. 1 are sometimes not explained. The present second embodiment of the present invention includes the adaptive codebook circuit 110 and the adder 160, in addition to the components of FIG. 1.

The voiced/unvoiced discriminating circuit 200 is supplied with the narrow-band input signal x(n) to verify whether a frame-based signal is voiced or unvoiced. For verifying whether the frame-based signal is voiced or unvoiced, a normalized autocorrelation function D(T) up to the predetermined delay time m is derived for the narrow-band input signal x(n) in accordance with the equation (1), and a maximum value of D(T) is found. If the maximum value of D(T) is larger than a predetermined threshold value, the input signal is determined to be voiced. If otherwise, the input signal is determined to be unvoiced.

For the voiced frame, the voiced/unvoiced discriminating circuit 200 sends the value of T, maximizing the normalized autocorrelation function D(T), as a pitch period T to the adaptive codebook circuit 110.

The adaptive codebook circuit 110 is supplied from the voiced/unvoiced discriminating circuit 200 with the delay T of the adaptive codebook and, based on the past sound source signal v(n), generates an adaptive code vector p(n), in accordance with the following equation (2):

$$p(n)=v(n-T) \tag{2}$$

and outputs the so generated vector to the gain circuit 340.

The gain circuit 340 is supplied from the gain adjustment circuit 310 with a gain which is then multiplied with an output signal of at least one of the adaptive codebook circuit 110 and the noise generating circuit 120. The resulting signal is output to the adder 160.

The adder 160 sums the two signals, output from the gain circuit 340, and outputs the resulting sum signal to the synthesis filter circuit 170 and to the adaptive codebook circuit 110.

The synthesis filter circuit 170 is supplied with an output signal (sound source signal) of the adder 160 and with a filter coefficient of a predetermined number of orders from the coefficient calculating circuit 130 to form a synthesis filter, and outputs a signal y(n) of a high frequency range needed for band extension.

The gain adjustment circuit 310 is supplied with the voiced/unvoiced discrimination information from the voiced/unvoiced discriminating circuit 200, and adjusts the gain of the adaptive codebook signal and the gain of the noise signal, depending on whether the input signal is voiced or unvoiced, to send the gain-adjusted signal to the gain circuit 340.

The adder 190 sums the output signal y(n) of the synthesis filter circuit 170 to the output signal s(n) of the sampling frequency converting circuit 180 to form and output an ultimately band extended signal.

Figure 6:
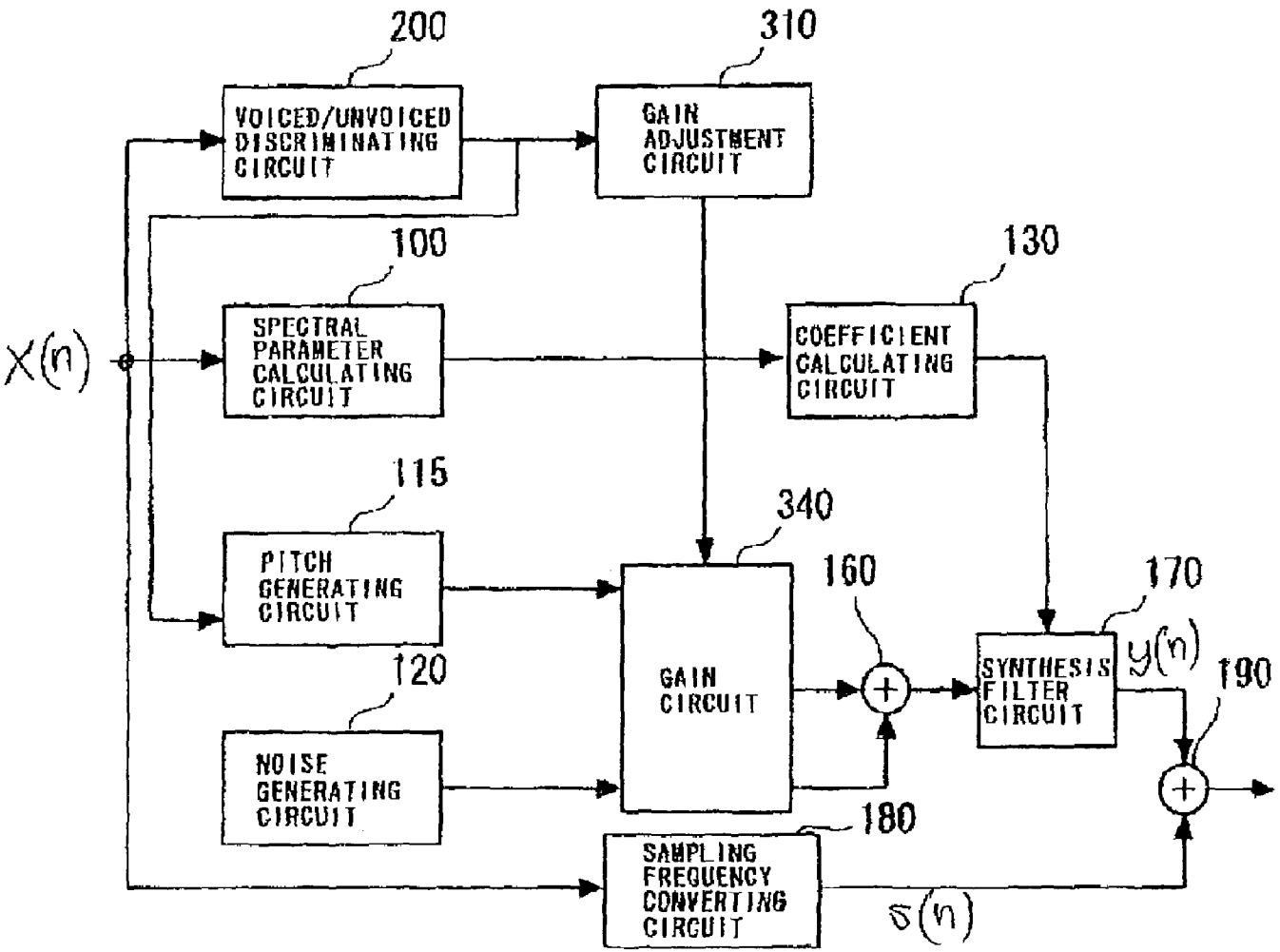
FIG. 6 is a diagram showing a modification of the second embodiment of the present invention.

With the second embodiment of the present invention, an adaptive codebook signal is generated, using a delay calculated from the narrow-band input signal, based on the past sound source signal of high frequency portion, and are then multiplied with a proper gain. The resulting signal is then summed to e.g. a noise signal, whereby a band extended signal with superior sound quality may be generated for e.g. a vowel in case periodicity is needed for a high frequency portion. The above completes explanation of the second embodiment. As a modification of the second embodiment of the present invention, a pitch generating circuit 115 may be provided in place of the adaptive codebook circuit 110, as shown in FIG. 6. The pitch generating circuit 115 calculates a pitch period from an input signal and generates a periodic signal based on the pitch period to output the so generated pitch signal to the gain circuit 340. Except for the pitch generating circuit 115, the modification is the same in the configuration as the above-described second embodiment.

Figure 3:
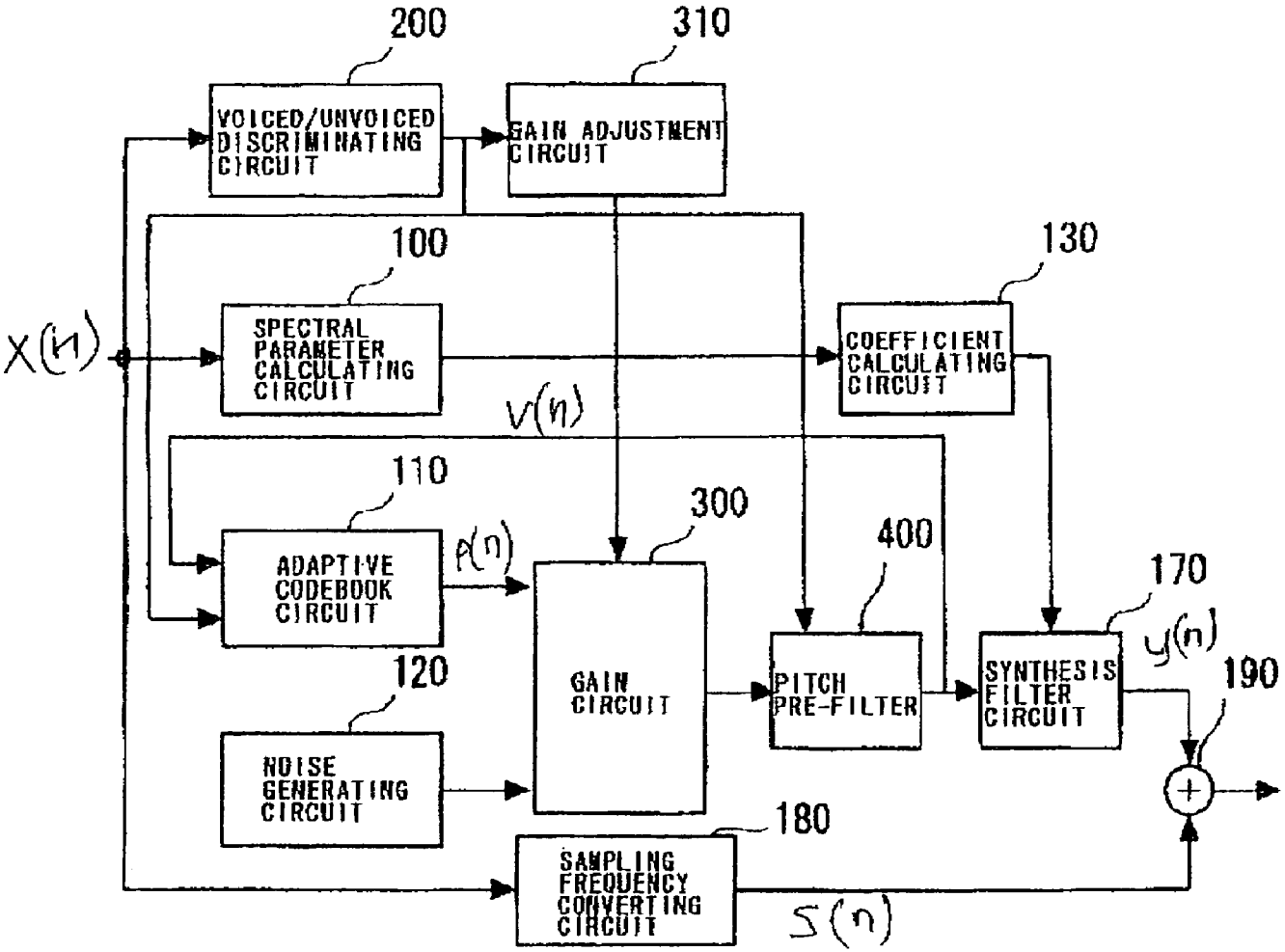
FIG. 3 is a diagram showing a configuration of a third embodiment of the present invention.

FIG. 3 shows the configuration of a third embodiment of the present invention. Referring to FIG. 3, the band extending apparatus of the third embodiment includes a spectral parameter calculating circuit 100, an adaptive codebook circuit 110, a noise generating circuit 120, a coefficient calculating circuit 130, a gain circuit 300, a synthesis filter circuit 170, a sampling frequency converting circuit 180, an adder 190, a voiced/unvoiced discriminating circuit 200, a gain adjustment circuit 310, and a pitch pre-filter 400. In FIG. 3, the same reference numerals are used to depict the parts or components which are the same as those shown in FIGS. 1 and 2. In the following, only the points of difference from the second embodiment are explained, whilst the same parts or components as those of FIG. 2 are sometimes not explained.

The gain circuit 300 is supplied with the gain from the gain adjustment circuit 310 and multiplies the output signals of the adaptive codebook circuit 110 and the noise generating circuit 120 with the gain. The resulting two signals are summed together and the resulting sum signal is output to the pitch pre-filter 400.

The pitch pre-filter 400 is supplied with the delay T from the voiced/unvoiced discriminating circuit 200, and performs pre-filtering on the sound source signal v(n) in accordance with the following equation (3):

$$v'(n)=v(n)+\beta p(n-T) \tag{3}$$

to output the resulting signal to the synthesis filter circuit 170.

An output of the pitch pre-filter 400 is also supplied to the adaptive codebook circuit 110.

The synthesis filter circuit 170 is supplied with an output signal of the pitch pre-filter 400 and with coefficients of a predetermined number of orders from the coefficient calculating circuit 130 to form a filter, and outputs a signal y(n) of a high frequency range needed for band extension.

By employing the pitch pre-filter 400 for pre-filtering the sound source signal, using the delay, a band extended signal of superior sound quality may be produced. The above completes the explanation of the third embodiment. In the present embodiment, as in the modification of the second embodiment, a pitch generating circuit may, of course, be used in place of the adaptive codebook circuit 110.

Figure 4:
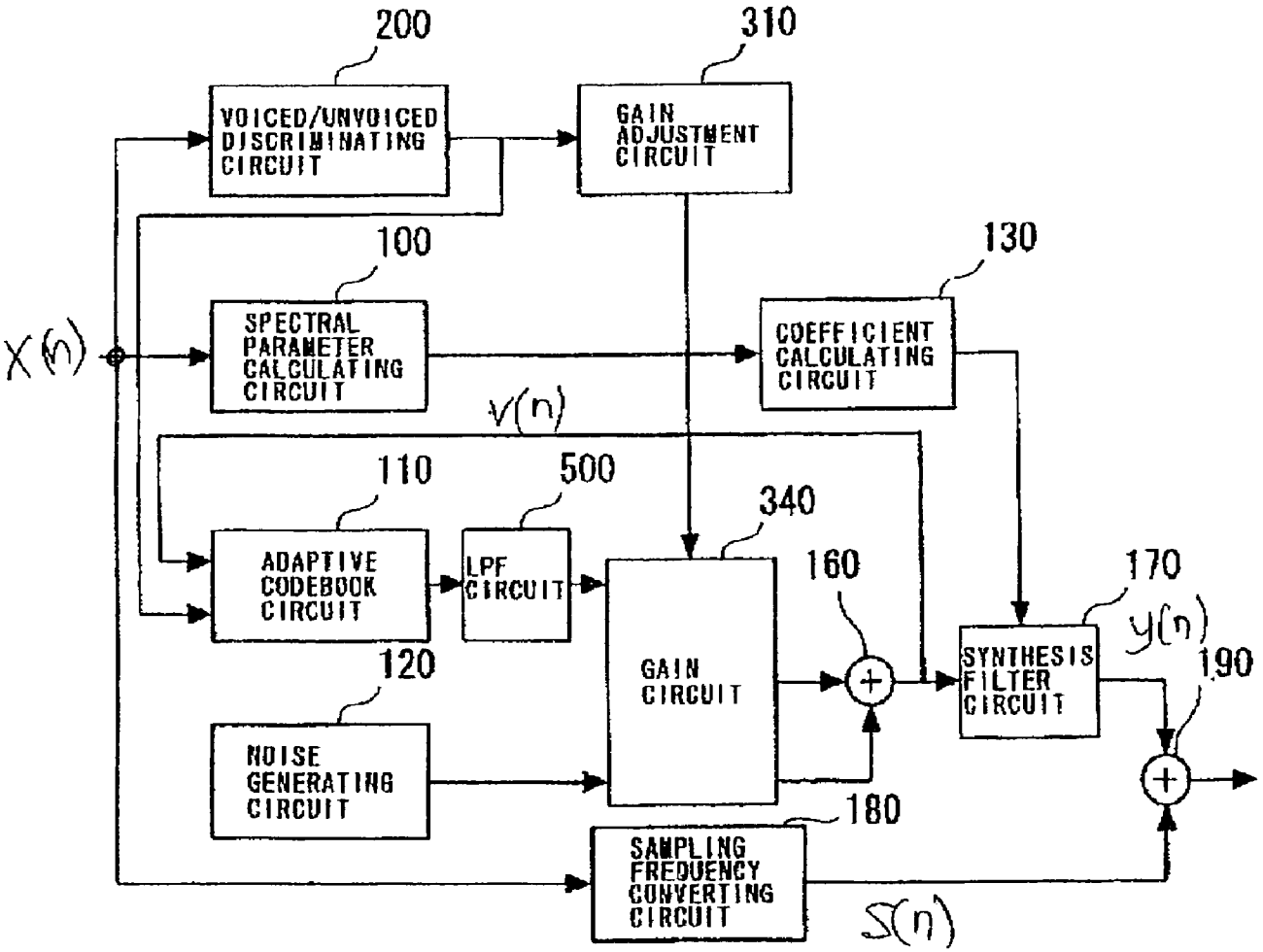
FIG. 4 is a diagram showing a configuration of a fourth embodiment of the present invention.

FIG. 4 shows the configuration of a fourth embodiment of the present invention. Referring to FIG. 4, the band extending apparatus of the fourth embodiment includes a spectral parameter calculating circuit 100, an adaptive codebook circuit 110, a noise generating circuit 120, a coefficient calculating circuit 130, a gain circuit 340, an adder 160, a synthesis filter circuit 170, a sampling frequency converting circuit 180, an adder 190, a voiced/unvoiced discriminating circuit 200, a gain adjustment circuit 310, and a low-pass filter circuit 500. In FIG. 4, the same reference numerals are used to depict the parts or components which are the same as those shown in FIG. 2. In the fourth embodiment, the low-pass filter 500 is added to the configuration of the above-described second embodiment shown in FIG. 2. In the following, only the points of difference from the second embodiment are explained, whilst the same parts or components as those of FIG. 2 are explained only as necessary.

The low-pass filter 500 filters the output signal of the adaptive codebook circuit 110 in accordance with the equation:

$$p'(n)=p(n)*h(n) \tag{4}$$

to permit a signal with a frequency not higher than a predetermined cut-off frequency to pass therethrough to the gain circuit 340. The cut-off frequency of the low-pass filter 500 may be predetermined to, for example, 6 kHz. Meanwhile, in FIG. 4, h(n) denotes the impulse response of a low-pass filter, and a symbol "*" denotes the operation of convolution.

The foregoing completes the explanation of the fourth embodiment of the present invention. Meanwhile, a pitch generating circuit may be used in place of the adaptive codebook circuit 110, by way of a modification of the present fourth embodiment, as in the modification of the second embodiment described above.

Figure 5:
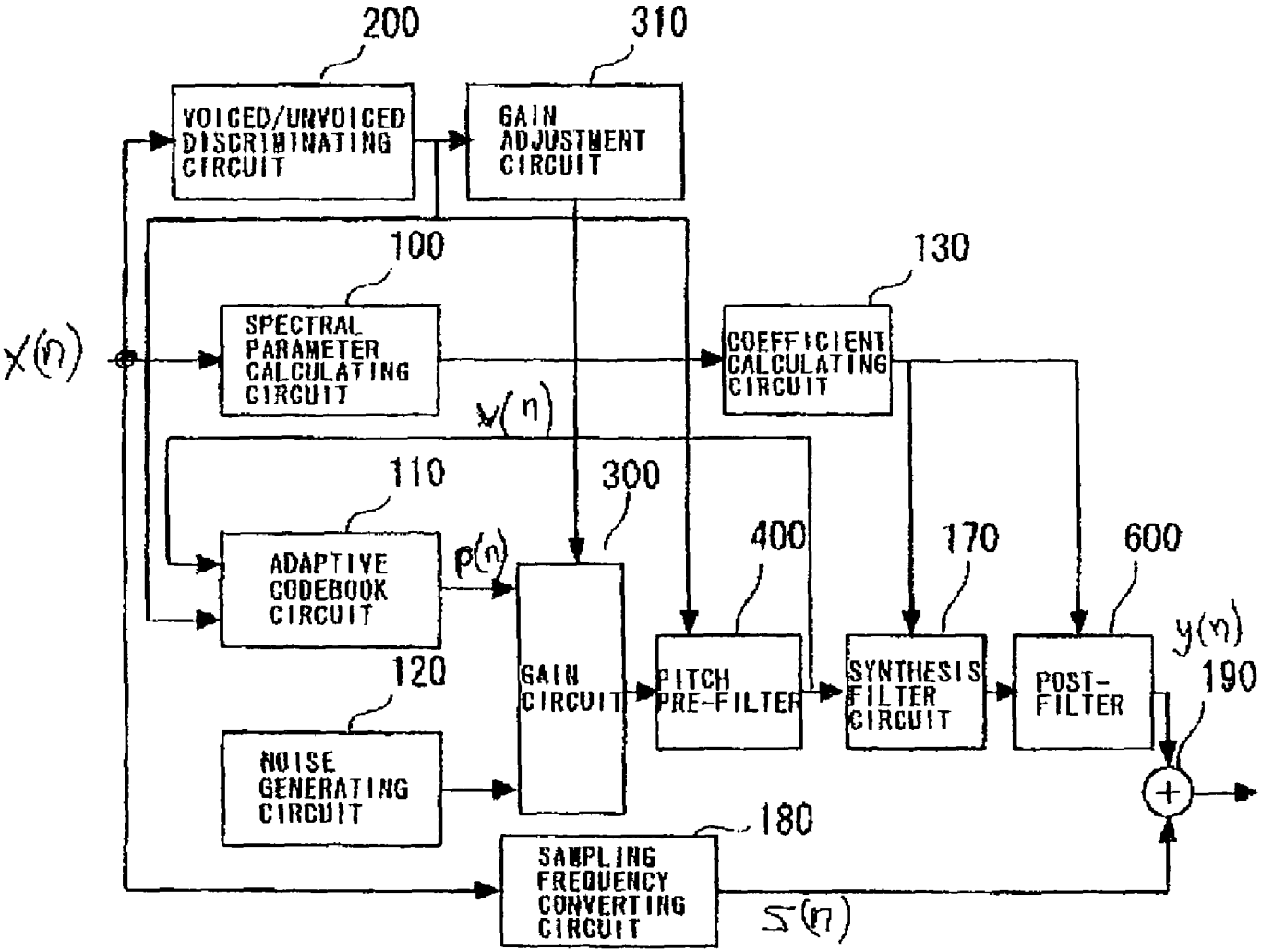
FIG. 5 is a diagram showing a configuration of a fifth embodiment of the present invention.

FIG. 5 shows the configuration of a fifth embodiment of the present invention. Referring to FIG. 5, the band extending apparatus of the fifth embodiment includes a spectral parameter calculating circuit 100, an adaptive codebook circuit 110, a noise generating circuit 120, a coefficient calculating circuit 130, a gain circuit 300, a synthesis filter circuit 170, a sampling frequency converting circuit 180, an adder 190, a voiced/unvoiced discriminating circuit 200, a gain adjustment circuit 310, a pitch pre-filter 400, and a post-filter 600. In FIG. 5, the same reference numerals are used to depict the same parts or components as those shown in FIG. 3. The fifth embodiment of the present invention includes the post-filter 600 in addition to the configuration of the above-described third embodiment. In the following, only the points of difference from the third embodiment are explained, whilst the same parts or components as those of FIG. 2 are explained only as necessary.

The post-filter 600 is supplied from the coefficient calculating circuit 130 with coefficients (filter coefficients), which then are weighted. The post-filter then performs post-filtering in accordance with the equation (5):

$$y'(n)=y(n)-\Sigma a_i\gamma_1^i y(n-i)+\Sigma a_i\gamma_2^i y'(n-i) \quad (5)$$

in order to deliver an output to the adder 190.

By employing the post-filter 600, it is possible to generate a band extended signal of superior quality. The above completes the explanation of the fifth embodiment. It is noted that a pitch generating circuit may also be used in place of the codebook circuit 110, by way of a modification of the fourth embodiment, as in the modification of the second embodiment described above.

The configurations of the above-described embodiments may also be combined together, such as by employing the post-filter, explained in the fifth embodiment, for the above-described first embodiment. In the present invention, plural sorts of the preset frequency band signal (narrow-band signal) may be input, in place of only one sort of the signals. Although the present invention has been explained with reference to the above specific embodiments, it is to be noted that the present invention may encompass various modifications or corrections that may be occur to those skilled in the art within the scope of the invention as defined in the claims.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items may fall under the modifications aforementioned.

What is claimed is:

1. A band extending apparatus comprising:

a spectral parameter calculating unit, receiving at least an input signal of a preset frequency band to calculate spectral parameters representing spectral characteristics;

a noise generating unit for generating a noise signal;

a coefficient calculating unit for shifting the frequency of said spectral parameters to then find filter coefficients;

a gain unit for supplying a gain to an output of said noise generating unit;

a synthesis filter unit for passing an output signal of said gain unit through a synthesis filter, formed using said filter coefficients, to reproduce a signal for band extension;

means for adding a signal corresponding to said input signal converted in a sampling frequency thereof to an output signal of said synthesis filter unit to generate a band extended signal; and a voiced/unvoiced discriminating circuit, receiving said input signal of the preset frequency band, to verify whether the input signal in terms of a frame as a unit is voiced or unvoiced;

wherein said gain unit includes:

a gain adjustment unit, receiving voiced/unvoiced discrimination information output from said voiced/unvoiced discriminating circuit, to adjust the gain to be imparted to the output signal of said noise generating circuit, depending on whether said voiced/unvoiced discrimination information indicates voiced or unvoiced; and a gain circuit, receiving said gain adjusted by said gain adjustment unit to multiply the output signal of said noise generating unit with said gain to output the resulting signal.

2. The band extending apparatus as defined in claim 1, wherein said voiced/unvoiced discriminating circuit derives a normalized autocorrelation function up to a preset delay time, for said input signal of the preset band, and verifies whether the input signal is voiced or unvoiced, based on the relative magnitude of the maximum value of said normalized autocorrelation function and a preset threshold value, to output said voiced/unvoiced discrimination information.

3. The band extending apparatus as defined in claim 1, wherein a post-filter is formed using weighting coefficients as weighted version of filter coefficients output from said coefficient calculating unit, and wherein an output signal of said synthesis filter unit is passed through said post-filter to reproduce the signal for band extension.

4. The band extending apparatus as defined in claim 3, wherein said means for summing the signal corresponding to said input signal converted in a sampling frequency thereof to an output signal of said synthesis filter unit to generate a band extended signal includes a sampling frequency converting circuit for up-sampling said input signal with a pre-set sampling frequency to output the resulting up-sampled signal; and an adder, receiving and summing an output signal of said sampling frequency converting circuit and an output signal of said post-filter to output the resulting sum signal as said band extended signal.

5. The band extending apparatus as defined in claim 1, wherein said means for summing a signal corresponding to said input signal converted in a sampling frequency thereof to an output signal of said synthesis filter unit to generate a band extended signal includes:

a sampling frequency converting circuit for up-sampling said input signal with a pre-set sampling frequency to output the resulting up-sampled signal; and an adder, receiving and summing an output signal of said sampling frequency converting circuit and an output signal of said synthesis filter to output the resulting sum signal as said band extended signal.

6. A band extending apparatus comprising:

a spectral parameter calculating unit, receiving at least an input signal of a preset frequency band to calculate spectral parameters representing spectral characteristics;

an adaptive codebook unit, calculating a pitch period at least from said input signal to generate an adaptive codebook component based on said pitch period and a past sound source signal;

a noise generating unit for generating a noise signal;

a coefficient calculating unit for shifting the frequency of said spectral parameters to find filter coefficients;

a gain unit for supplying a gain to at least one of an output signal of said noise generating unit and an output signal of said adaptive codebook unit and outputting a sound source signal;

a synthesis filter unit, receiving said sound source signal from said gain unit to a synthesis filter formed using said filter coefficients to reproduce a signal for band extension;

means for summing a signal corresponding to said input signal converted in a sampling frequency thereof to an output signal of said synthesis filter unit to produce a band extended signal; and a voiced/unvoiced discriminating circuit, receiving said input signal of the preset frequency band, to verify whether the input signal in terms of a frame as a unit is voiced or unvoiced, and for supplying, for a voiced frame, a preset delay derived from said voiced/unvoiced decision, as a pitch period to an adaptive codebook circuit forming said adaptive codebook unit;

said adaptive codebook circuit, receiving the delay from said voiced/unvoiced discriminating circuit, as a delay of said adaptive codebook, generating an adaptive codebook signal based on the past sound source signal, and outputting the adaptive codebook signal generated;

said gain unit including:

a gain adjustment unit, receiving voiced/unvoiced discrimination information from said voiced/unvoiced discriminating circuit, to adjust the gain of the output signal of said adaptive codebook circuit and the gain of the output signal of said noise generating unit, to output the resulting signals, depending on whether said voiced/unvoiced discrimination information indicates voiced or unvoiced;

a gain circuit, receiving said gain from said gain adjustment circuit to multiply at least one of the output signal of said adaptive codebook circuit and the output signal of said noise generating circuit with said gain to output the sound source signal; and an adder for summing two output signals from said gain circuit to output the results of addition to said synthesis filter and to said adaptive codebook circuit.

7. The band extending apparatus as defined in claim 6, wherein said voiced/unvoiced discriminating circuit derives a normalized autocorrelation function up to a preset delay time, for said input signal of the preset band, and verifies whether the input signal is voiced or unvoiced, based on the relative magnitude of the maximum value of said normalized autocorrelation function and a preset threshold value, to output said voiced/unvoiced discrimination information, and wherein said voiced/unvoiced discriminating circuit outputs, for a voiced frame, the delay maximizing said normalized autocorrelation function as a pitch period.

8. The band extending apparatus as defined in claim 6, further comprising:

a low-pass filter, receiving an output signal of said adaptive codebook unit as an input.

9. A band extending apparatus comprising:

a spectral parameter calculating unit, receiving at least with an input signal of a preset frequency band to calculate spectral parameters representing spectral characteristics;

an adaptive codebook unit for calculating a pitch period at least from said input signal to generate an adaptive codebook component based on said pitch period and past sound source signal;

a noise generating unit for generating a noise signal;

a coefficient calculating unit for shifting the frequency of said spectral parameters to then find filter coefficients;

a gain unit for supplying a gain to at least one of an output of said noise generating unit and an output signal of said adaptive codebook unit and outputting a sound source signal;

a pitch pre-filter for filtering said sound source signal from said gain unit, using said pitch period;

a synthesis filter unit for supplying an output signal of said pitch pre-filter to a synthesis filter formed using said filter coefficients to generate band-expanding signal;

means for summing a signal corresponding to said input signal converted in a sampling frequency thereof to an output signal of said synthesis filter unit to generate a band extended signal; and a voiced/unvoiced discriminating circuit, receiving said input signal of the preset frequency band, to verify whether the input signal in terms of a frame as a unit is voiced or unvoiced, and for supplying, for a voiced frame, a preset delay derived from said voiced/unvoiced decision, as a pitch period, to an adaptive codebook circuit forming said adaptive codebook unit and to said pitch pre-filter;

said adaptive codebook circuit, receiving a delay from said voiced/unvoiced discriminating circuit as a delay of the adaptive codebook to generate and output an adaptive codebook signal based on a past sound source signal;

said gain unit including:

a gain adjustment circuit, receiving voiced/unvoiced discrimination information from said voiced/unvoiced discriminating circuit, to adjust the gain of the output signal of said adaptive codebook circuit and the gain of the output signal of said noise generating unit, to output the resulting signals, depending on whether said voiced/unvoiced discrimination information indicates voiced or unvoiced; and a gain circuit receiving said gain from said gain adjustment circuit to multiply at least one of the output signal of said adaptive codebook circuit and the output signal of said noise generating unit with said gain, to sum two resulting output signals, at least one of which has been multiplied with said gain, to output the result of addition to said pitch pre-filter;

an output signal of said pitch pre-filter being supplied to said synthesis filter and to said adaptive codebook circuit.

10. A band extending apparatus comprising:

a spectral parameter calculating unit, receiving at least with an input signal of a preset frequency band to calculate spectral parameters representing spectral characteristics;

a pitch generating unit, calculating a pitch period at least from said input signal to generate a period signal using said pitch period;

a noise generating unit for generating a noise signal;

a coefficient calculating unit for shifting the frequency of said spectral parameters to find filter coefficients;

a gain unit for supplying a proper gain to at least one of an output signal of said noise generating unit and an output signal of said pitch generating unit and outputting a sound source signal;

a synthesis filter unit, receiving said sound source signal from said gain unit to a synthesis filter, formed using said filter coefficients, to reproduce a signal for band extension;

means for summing a signal corresponding to said input signal converted in a sampling frequency thereof to an output signal of said synthesis filter unit, to produce a band extended signal; and a voiced/unvoiced discriminating circuit, receiving said input signal of the preset frequency band, to verify whether the input signal in terms of a frame as a unit is voiced or unvoiced, and for supplying, for a voiced frame, a preset delay derived from said voiced/unvoiced decision, as a pitch period, to said pitch generating unit;

said gain unit including:

a gain adjustment circuit, receiving voiced/unvoiced discrimination information output from said voiced/unvoiced discriminating circuit, to adjust the gain of the output signal of said pitch generating unit and the gain of said noise generating circuit, depending on whether said voiced/unvoiced discrimination information indicates voiced or unvoiced to output the resulting signals;

a gain circuit, receiving said gain from said gain adjustment circuit to multiply at least one of the output signal of said pitch generating unit and the output signal of said noise generating circuit with said gain to output the sound source signal; and an adder for summing the two output signals from said gain circuit to output the results of addition to said synthesis filter.

11. A band extending apparatus comprising:

a spectral parameter calculating unit, receiving at least an input signal of a preset frequency band to calculate spectral parameters representing spectral characteristics;

a pitch generating unit for calculating a pitch period at least from said input signal to generate a period signal using said pitch signal;

a noise generating unit for generating a noise signal;

a coefficient calculating unit for shifting the frequency of said spectral parameters to then find filter coefficients;

a gain unit for supplying a gain to at least one of an output signal of said noise generating unit and an output signal of said pitch generating unit and for outputting a sound source signal;

a pitch pre-filter for filtering said sound source signal from said gain unit, using said pitch period;

a synthesis filter unit, receiving an output signal of said pitch pre-filter to reproduce a signal for band extension;

means for summing a signal corresponding to said input signal converted in a sampling frequency thereof to an output signal of said synthesis filter unit to obtain a band extended signal; and a voiced/unvoiced discriminating circuit, receiving said input signal of the preset frequency band, to verify whether the input signal in terms of a frame as a unit is voiced or unvoiced, and for supplying, for a voiced frame, a preset delay derived from said voiced/unvoiced decision, as a pitch period to said pitch generating unit and to said pitch pre-filter;

said gain unit including:

a gain adjustment circuit, receiving voiced/unvoiced discrimination information, output from said voiced/unvoiced discriminating circuit, to adjust the gain of the output signal of said pitch generating unit and the gain of said noise generating circuit, depending on whether said voiced/unvoiced discrimination information indicates voiced or unvoiced, to output the resulting signals; and a gain circuit, receiving said gain from said gain adjustment unit to multiply at least one of the output signal of said pitch generating unit and the output signal of said noise generating circuit with said gain to output the results of addition of two resulting signals to said synthesis filter.

12. A band extending method comprising:

receiving at least an input signal of a preset frequency band to calculate spectral parameters representing spectral characteristics;

shifting the frequency of said spectral parameters to then find filter coefficients;

supplying a gain to a noise signal generated by a noise generating unit;

passing a signal, added by said gain, through a synthesis filter, formed using said filter coefficients, to reproduce a signal for band extension;

summing a signal corresponding to said input signal converted in a sampling frequency thereof to an output signal of said synthesis filter unit to generate a band extended signal;

verifying, by a voiced/unvoiced discriminating circuit, supplied with aid input signal of the preset frequency band, whether a signal in terms of a frame as a unit is voiced or unvoiced;

adjusting the gain of the output signal of said noise generating unit, depending on the results of voiced/unvoiced discrimination; and outputting a signal corresponding to the output signal of said noise generating unit multiplied by said adjusted gain to said synthesis filter.

13. The band extending method as defined in claim 12, further comprising:

deriving, by said voiced/unvoiced discriminating circuit, a normalized autocorrelation function up to a preset delay time, for said input signal of the preset frequency band, and verifying whether the input signal is voiced or unvoiced, based on the relative magnitude of the maximum value of said normalized autocorrelation function and a preset threshold value, to output said voiced/unvoiced discrimination information.

14. The band extending method as defined in claim 12, comprising:

passing an output signal of said synthesis filter through a post-filter formed using weighting coefficients corresponding to weighted version of said filter coefficients to reproduce the signal for band extension.

15. The band extending method as defined in claim 14, wherein the processing of summing a signal corresponding to said input signal converted in a sampling frequency thereof to an output signal of said synthesis filter unit to generate a band extended signal includes:

up-sampling said input signal with a pre-set sampling frequency to output the resulting up-sampled signal; and receiving and summing said up-sampled signal and an output signal of said post-filter to output the resulting sum signal as said band extended signal.

16. The band extending method as defined in claim 12, wherein the processing of summing a signal corresponding to said input signal converted in a sampling frequency thereof to an output signal of said synthesis filter unit to generate a band extended signal, includes:

up-sampling said input signal with a pre-set sampling frequency to output the resulting up-sampled signal; and receiving and summing said up-sampled signal and an output signal of said synthesis filter to output the resulting sum signal as said band extended signal.

17. A band extending method comprising:

receiving at least an input signal of a preset frequency band to calculate spectral parameters representing spectral characteristics;

calculating a pitch period at least from said input signal to generate an adaptive codebook component based on said pitch period and a past sound source signal;

shifting the frequency of said spectral parameters to find filter coefficients;

supplying a gain to at least one of a noise signal from a noise generating unit and to said adaptive codebook component and outputting a sound source signal;

receiving said sound source signal from said gain unit to a synthesis filter formed using said filter coefficients to reproduce a signal for band extension;

summing a signal corresponding to said input signal converted in a sampling frequency thereof to an output signal of said synthesis filter unit to obtain a band extended signal;

discriminating whether a signal in terms of a frame as a unit is voiced or unvoiced, by a voiced/unvoiced discriminating circuit, receiving said input signal of the preset frequency band, and for supplying, for a voiced frame, a preset delay derived from said voiced/unvoiced decision, as a pitch period, to an adaptive codebook circuit;

receiving, by said adaptive codebook circuit, the delay from said voiced/unvoiced discriminating circuit, as a delay of said adaptive codebook, and generating and output an adaptive codebook signal, based on past sound source signal;

receiving voiced/unvoiced discrimination information from said voiced/unvoiced discriminating circuit, and adjusting the gain of the output signal of said adaptive codebook circuit and the gain of the output signal of said noise generating unit, to output the resulting signals, depending on whether said voiced/unvoiced discrimination information indicates voiced or unvoiced;

multiplying at least one of the output signal of said adaptive codebook circuit and the output signal of said noise generating circuit with said adjusted gain to output the sound source signal; and summing two output signals, at least one of which has been multiplied with said gain, to output the results of addition to said synthesis filter and to said adaptive codebook circuit.

18. The band extending method as defined in claim 17, further comprising:

deriving, by said voiced/unvoiced discriminating circuit, a normalized autocorrelation function up to a preset delay time, for said input signal of the preset frequency band, and verifying whether the input signal is voiced or unvoiced, based on the relative magnitude of the maximum value of said normalized autocorrelation function and a preset threshold value, outputting said voiced/unvoiced discrimination information, and outputting, for a voiced frame, the delay maximizing said normalized autocorrelation function as a pitch period.

19. The band extending method as defined in claim 17, further comprising:

processing said adaptive codebook component with a low-pass filter to allow frequency components not higher than a preset cut-off frequency to pass therethrough.

20. A band extending method comprising:

receiving at least an input signal of a preset frequency band to calculate spectral parameters representing spectral characteristics;

calculating a pitch period at least from said input signal to generate an adaptive codebook component based on said pitch period and the past sound source signal;

shifting the frequency of said spectral parameters to then find filter coefficients;

supplying a gain to at least one of a noise signal from a noise generating unit and said adaptive codebook component and outputting a sound source signal;

pre-filtering said sound source signal, using said pitch period;

supplying the results of processing of said pitch pre-filter to a synthesis filter formed using said filter coefficients to generate a signal for band extension;

summing a signal corresponding to said input signal converted in a sampling frequency thereof to an output signal of said synthesis filter unit to generate a band extended signal;

discriminating, by a voiced/unvoiced discriminating circuit, supplied with said input signal of the preset frequency band, whether the input signal in terms of a frame as a unit is voiced or unvoiced, and for supplying, for a voiced frame, a preset delay derived from said voiced/unvoiced decision, as a pitch period, to an adaptive codebook circuit and to said pitch pre-filter;

receiving, by said adaptive codebook circuit, a delay from said voiced/unvoiced discriminating circuit as a delay of the adaptive codebook to generate and output an adaptive codebook signal based on the past sound source signal;

receiving voiced/unvoiced discrimination information from said voiced/unvoiced discriminating circuit, and adjusting the gain of the output signal of said adaptive codebook circuit and the gain of the output signal of said noise generating unit, to output the resulting signals, depending on whether said voiced/unvoiced discrimination information indicates voiced or unvoiced; and multiplying at least one of the output signal of said adaptive codebook circuit and the output signal of said noise generating unit with said adjusted gain and summing two resulting output signals, at least one of which has been multiplied with said gain, to output the result of addition to said pitch pre-filter; and supplying an output signal of said pitch pre-filter to said synthesis filter and to said adaptive codebook circuit.

21. A band extending method comprising:

receiving at least an input signal of a preset frequency band to calculate spectral parameters representing spectral characteristics;

calculating a pitch period at least from said input signal to generate a period signal using said pitch period;

shifting the frequency of said spectral parameters to find filter coefficients;

supplying a gain to at least one of a noise signal of said noise generating unit and said period signal and outputting a sound source signal;

receiving said sound source signal to a synthesis filter formed using said filter coefficients to reproduce a signal for band extension;

summing a signal, corresponding to said input signal converted in a sampling frequency thereof to an output signal of said synthesis filter unit to obtain a band extended signal;

verifying, by a voiced/unvoiced discriminating circuit, supplied with the input signal of the preset frequency band, whether the input signal in terms of a frame as a unit is voiced or unvoiced, and for supplying, for a voiced frame, a preset delay derived from said voiced/unvoiced decision, as a pitch period, to said pitch generating unit;

receiving voiced/unvoiced discrimination information from said voiced/unvoiced discriminating circuit, and adjusting the gain of the output signal of said pitch generating unit and the gain of said noise generating circuit, depending on whether said voiced/unvoiced discrimination information indicates voiced or unvoiced;

multiplying at least one of the output signal of said pitch generating unit and the output signal of said noise generating circuit with said adjusted gain to output the sound source signal; and summing the two output signals and outputting the results of addition to said synthesis filter.

22. A band extending method comprising:

receiving at least an input signal of a preset frequency band and calculating spectral parameters representing spectral characteristics;

calculating a pitch period at least from said input signal to generate a period signal using said pitch signal;

shifting the frequency of said spectral parameters to then find filter coefficients;

supplying a gain to at least one of an output signal of said noise generating unit and said pitch signal and outputting a sound source signal;

pre-filtering said sound source signal using said pitch period;

receiving a signal representing the result of processing by said pitch pre-filter to a synthesis filter formed using said pitch period to reproduce a signal for band extension;

summing a signal corresponding to said input signal converted in a sampling frequency thereof to an output signal of said synthesis filter unit to produce a band extended signal;

verifying, by a voiced/unvoiced discriminating circuit, supplied with the input signal of said preset frequency band, whether the input signal in terms of a frame as a unit is voiced or unvoiced, and supplying, for a voiced frame, a preset delay derived from said voiced/unvoiced decision, as a pitch period, to said pitch generating unit;

adjusting the gain of the output signal of said pitch generating unit and the gain of said noise generating circuit, depending on whether said voiced/unvoiced discrimination information from said voiced/unvoiced discriminating circuit indicates voiced or unvoiced; and multiplying at least one of the output signal of said pitch generating unit and the output signal of said noise generating circuit with said adjusted gain to output the results of addition of two output signals, at least one of which has been multiplied with said gain, to said synthesis filter.

* * * * *